United States Patent [19]

Kobayashi

[11] Patent Number: 4,811,449

[45] Date of Patent: Mar. 14, 1989

[54] CLEANER

[75] Inventor: Kiyoshi Kobayashi, Chiba, Japan

[73] Assignee: Kabushiki Kaisha Hoky (aka Hoky Corp.), Chiba, Japan

[21] Appl. No.: 107,640

[22] Filed: Oct. 13, 1987

[30] Foreign Application Priority Data

Oct. 13, 1986 [JP] Japan ..... 61-156396[U]

[51] Int. Cl.[4] ..... A47L 13/256; A47L 13/29

[52] U.S. Cl. ..... 15/231; 15/230.17

[58] Field of Search ..... 15/231, 232, 233, 228, 15/230.17, 147

[56] References Cited

U.S. PATENT DOCUMENTS

| | | | |
|---|---|---|---|
| 2,753,669 | 7/1956 | Larson | 15/231 X |
| 3,267,622 | 8/1966 | Frostad | 15/231 X |
| 3,684,325 | 8/1972 | Okun | 15/231 X |
| 3,737,938 | 6/1973 | Saltzstein | 15/231 |
| 4,225,998 | 10/1980 | Thielen . | |
| 4,351,133 | 9/1982 | Stoll et al. | 15/231 X |
| 4,685,167 | 8/1987 | Murray | 15/228 |

FOREIGN PATENT DOCUMENTS 47-35572 12/1972 Japan .

*Primary Examiner*—Peter Feldman

*Attorney, Agent, or Firm*—Wenderoth, Lind & Ponack

[57] ABSTRACT

A cleaner wherein the upper surface of a main body is provided with fasteners each of which includes a stopper arm portion which is opened and closed by slidably operating an opening and closing lever that is engageable with sides of the main body, while each side of the main body is provided with a pile composed of short tufts. A cloth having a larger area than that of the bottom of the main body is pierced with the pile to lock the same to the opposite sides of said main body, and the cloth is positively retained on the opposite sides of the main body by the stopper arm portions of the fasteners, so that the bottom of the main body is covered with the cloth.

3 Claims, 6 Drawing Sheets

CLEANER

FIELD OF THE IVNENTION

This invention relates to a cleaner, and particularly to a cleaner suitable in use for dusting.

DESCRIPTION OF THE RELATED ART

There is a conventional cleaner, for example as shown in FIG. 9 at 50, constructed such that a handle joint portion 54 is provided at the central portion of a holder 52 having a substantially rectangular section. Each opposite ends of the holder 52 includes a pair of clip attaching portions 56*a* and 56*b* extending from respective sides thereof, respectively, and clips 58*a* and 58*b* are pivoted on these clip attaching portions 56*a* and 56*b*, respectively (more specifically, two each of clips 58*a* and 58*b*, i.e. a total of four clips, are disposed on the respective sides of the opposite ends of the holder 52). Each of the clips 58*a* and 58*b* contains an engaging end portion 60 which engages with the upper portion of a side of the holder 52, and the engaging end portion 60 is releasably locked on the upper surface of said holder 52 by means of opening and closing operations of the clips 58*a* and 58*b*. A cloth 62 having a substantially square profile is placed so as to cover the bottom surface of said holder 52 and is enfolded up to the upper portion thereof. The cloth 62 is then locked to said holder 52 by closing the clips 58*a* and 58*b*, whereby the cloth 62 is maintained on said holder 52. Furthermore, reference numeral 64 designates a shifting handle.

In the prior art cleaner described above, a user releases the locking engagement of the holder 52 and the clips 58*a* and 58*b*, and then arranges the cloth 62 so as to cover the bottom surface of said holder 52 and enfolds the cloth up to the upper portion thereof, whereby the end portion of said cloth 62 is positioned between the clips 58*a* and 58*b* and the holder 52. Then, the clips 58*a* and 58*b* are closed to lock the cloth to the upper portion of said holder 52 thereby maintaining said cloth 62 on the holder 52. Thereafter, the user grips the handle 64 to place the cleaner 50 on any surface to be cleaned, and then such surface is dusted by causing the bottom surface of the cleaner to scrub the surface to be cleaned. As a result of cleaning, the cloth 62 becomes stained, and can be removed from the holder 52 by releasing the engagement of said cloth 62 and the clips 58*a* and 58*b*. Thereafter, a fresh cloth is secured to the holder 52 in accordance with the same operation as described above. As a result, a fresh dusting operation can be performed again.

According to such a conventional cleaner, however, when a user intends to exchange a stained cloth for a fresh cloth, the following difficult procedures are required. That is, first a plurality of clips must be opened, a cloth must be then rolled up to the upper portion of the holder, the user must then press down the rolled-in end portion of the cloth positioned on the upper portion of the holder thereon so as not to come off from the holder with one hand, the user must close the plural clips with his (her) other hand, whereby the cloth is engaged with and held by the holder. Therefore, such a conventional cleaner is very difficult to set up. More specifically, since the steps for exchanging the cloths as described above is complicated and requires both hands, such steps are particularly difficult for young people or a person who cannot use his (her) hands.

Moreover, since it is required to enfold a cloth up to the upper portion of the holder for holding the same on said holder, excessive cloth is necessary for forming such an enfolding portion for the upper portion of the holder and does not function as a dusting surface. Thus, the area of a piece of cloth to be used must be relatively large and the amount of required cloth with respect to an area to be cleaned is excessive, so that there is a disadvantage in that the cleaner is expensive.

OBJECT AND SUMMARY OF THE INVENTION

The present invention has been made in view of the above, and an object of the invention is to provide a cleaner which includes a pile composed of short tufts extending from the sides of a main body, fasteners engaging the upper surface of the main body, and a cloth having a somewhat larger area than that of the bottom surface of said main body pierced by said pile, the cloth detachably engaged with the sides of said main body by means of said fasteners, with the bottom surface of said main body covered with said cloth. Thus, according to the cleaner of the present invention, the cloth can be easily exchanged by performing a one hand operation so that the use of the cleaner is simple. Moreover, since such a cloth is positively held on the under surface of the holder, a portion of the cloth to be enfolded up to the upper surface of the holder is unnecessary, and as a result, a ratio of the surface to be used for cleaning with respect to the whole area of the cloth is relatively small so that an efficient of use of cloth is facilitated.

It is to be noted that there are wet dusting, dry dusting and chemical dusting which is effected by the use of a so-called chemically treated cloth. In the cleaner of the present invention, either a normal fabric cloth or a chemically treated cloth is used depending on the type of dusting to be performed. Thus, the term "cloth" used herein includes both normal fabric and chemically treated cloths.

BRIEF DESCRIPTION OF THE DRAWINGS

FIG. 3(*b*) is an exploded perspective view showing the fastener;

FIG. 4(*b*) is a perspective view of a section of the fastener;

DETAILED DESCRIPTION OF PREFERRED EMBODIMENT

Figures 1, 2:
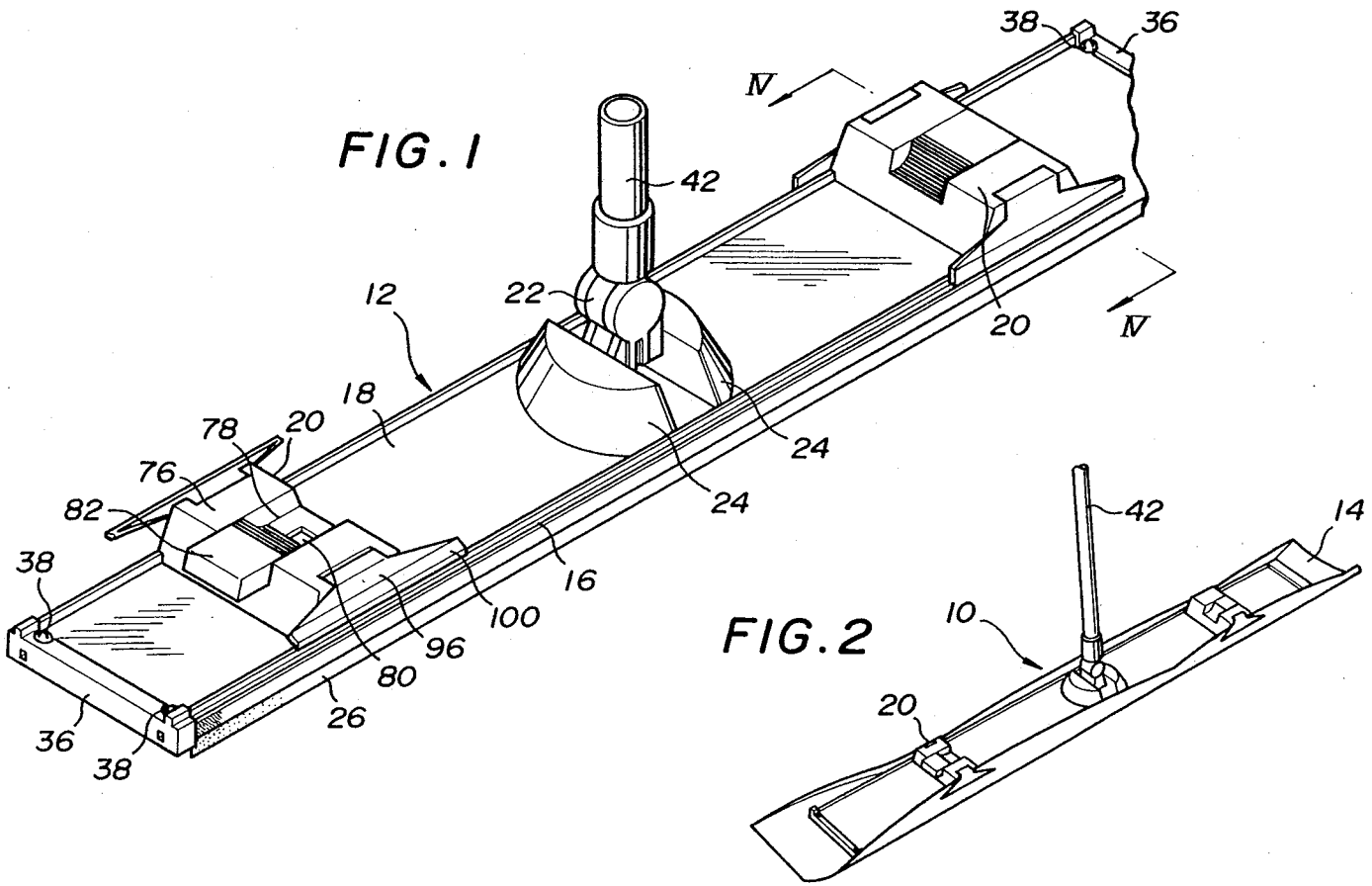
FIG. 1 is a perspective view illustrating an example of the cleaner according to the present invention.
FIG. 2 is a perspective view illustrating the operating state of the cleaner of FIG. 1.

The cleaner according to the present invention will be described in detail hereinbelow by referring to the accompanying drawings.

FIGS. 1 through 8 show an embodiment of the present invention wherein a cleaner 10 is composed of a main body 12 and a cloth 14. The main body 12 has an inverted U-shaped cross section and the bottom surface of the main body is open. A pair of fasteners 20 are disposed of substantially opposite end portions on a body (or holder) 18 having sides in which stepped portions 16, are defined respectively, along the longitudinal direction thereof. Joint engaging members 24 interconnect a joint 22 with body 18 and extend from the central portion of the body 18. A foundation 32 provided densely packed with tufts of a pile 30 is defined on the lower part 26 of the sides of the body 18 along the longitudinal direction thereof. A cushion member 34 made of an elastic material such as sponge, rubber or the like is disposed on the open part of the body 18. Side bumpers 36 for protecting the body 18 are secured to the opposite ends of the body 18 by means of machine screws 38.

The joint 22 is rotatably journaled on the joint engaging member 24 through a pin 40, and an operating handle 42 is threadedly engaged with the joint 22. The joint 22 is divided into a lower joint portion 44 and an upper joint portion 46, and these portions are rotatably journaled by means of a pin 48. A rotational resistance is imparted to the lower and upper joint portions 44 and 46 by means of a leaf spring **70*a* positioned on the body 18 for urging the lower joint portion 44 upwardly and a leaf spring 70*b* positioned on the lower joint portion 44 and arranged between the same and the upper joint portion 46, respectively, so that the operating handle 42** can be maintained at a suitable angle in forward and rearward as well as right hand and left hand directions.

The fastener 20 is fixedly attached to the body 18 in such a manner that a bolt 74 is inserted into a hole extending through bottom plate 72, and it is threadably attached to the body 18. A rectangular notch 80 is defined in a groove 78 of a cover 76 extending upward from bottom plate 72 and a cam member 90 has a standing up portion 88 engaged with a leg portion 84 defining an opening and a closing lever 82 slidably disposed in the notch 80. The profile of the cam member 90 is substantially triangular, and comprises a cam surface 92 and a run on surface 94, respectively. A stopper 96 is journaled to the cover 76 by means of a pin 98 in an openable and closable manner, and an arm portion 100 of the stopper is locked with the stepped portion 16 of the body 18 in its closed state. An intermediate supporting piece 102 extends from the stopper 96, is rotatably connected with a slider 106 by a pin 104, and has an extreme end portion 108 which engages with the cam surface 92. Oval recessed portions 110 are defined on the slider 106 and the bottom plate 72, respectively, and leg portions 112 of the cover 76 are located in these concave portions, whereby a sliding direction of the slider 106 is restricted. Furthermore, projections 114 are formed on the under surface of the slider, and a coiled spring 116 exerting an inwardly acting force (in the direction towards the center of the body) is placed between these projections 114.

Figure 8:
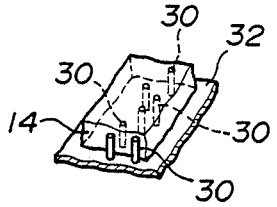
FIG. 8 is an enlarged view showing an essential part of a pile used in the cleaner.
Figure 9:
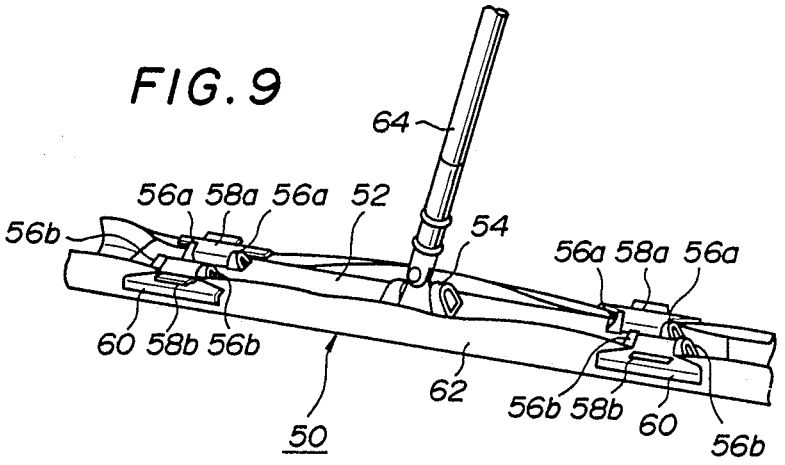
FIG. 9 is a schematic perspective view showing a conventional cleaner.

A preferred pile in the present invention is formed of tufts extending perpendicularly and directly from the foundation 32 in a densely aggregated state to define a pile 30 as shown in FIG. 8.

The cloth 14 has a profile similar to that of the bottom surface of the main body 12 and may be suitably selected depending on the type of cleaning or dusting to be performed such as wet dusting or dry dusting by means of a normal fabric cloth, or so-called chemical dusting with the use of a chemically treated cloth.

It is noted that since the cloth 14 is to be required to be retained by the pile 30, the cloth is desirably made from a material which is easily pierced by the pile.

Figure 3A:
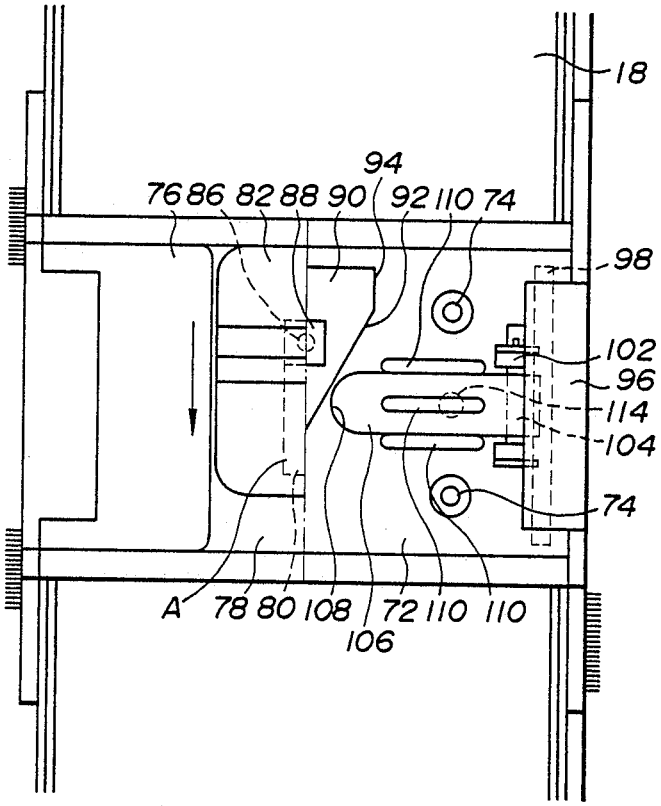
FIG. 3(*a*) is a plan view of a fastener in which the right side part from the center line of the fastener is shown with a cover and an opening and closing lever omitted.
Figure 3B:
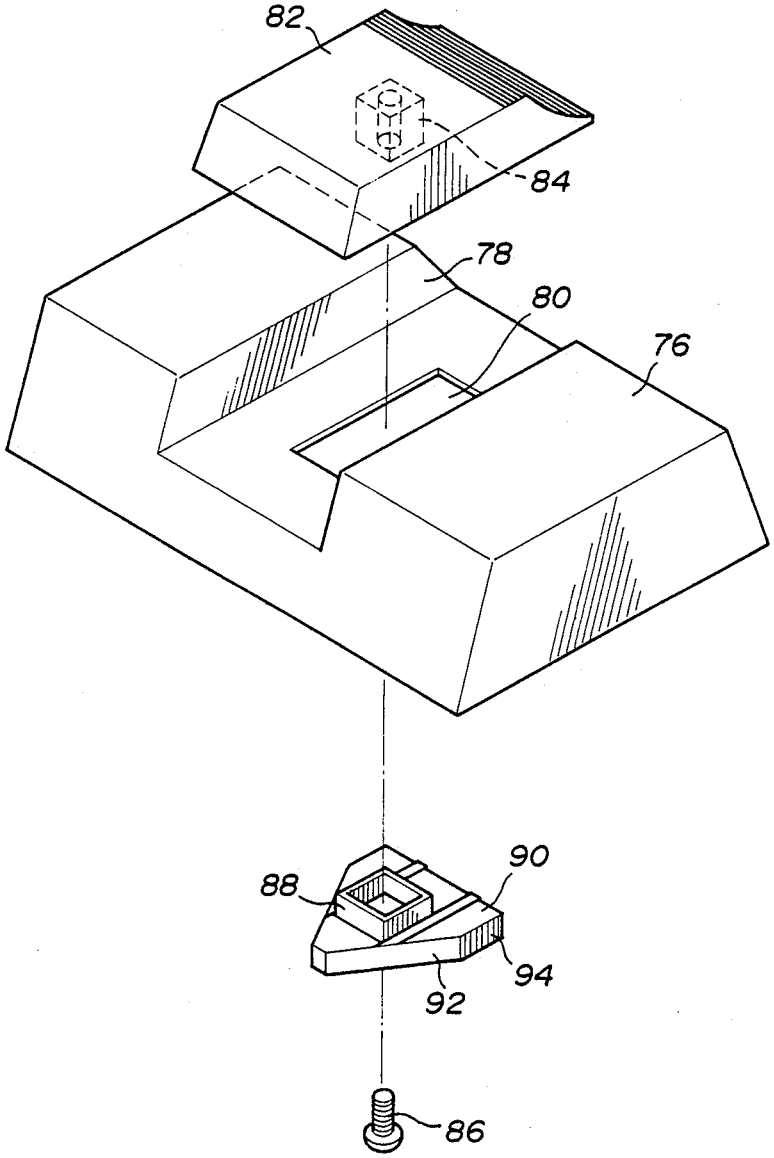
Figure 4A:
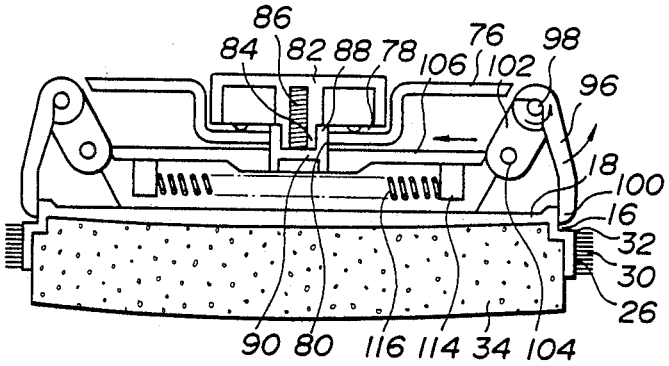
FIG. 4(*a*) is a sectional view taken along the line IV—IV of FIG. 1.
Figure 4B:
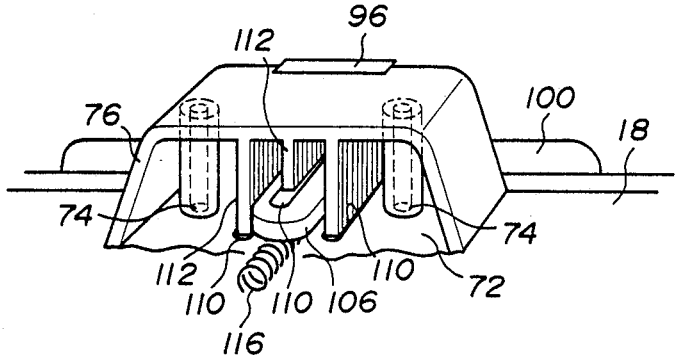
Figure 5:
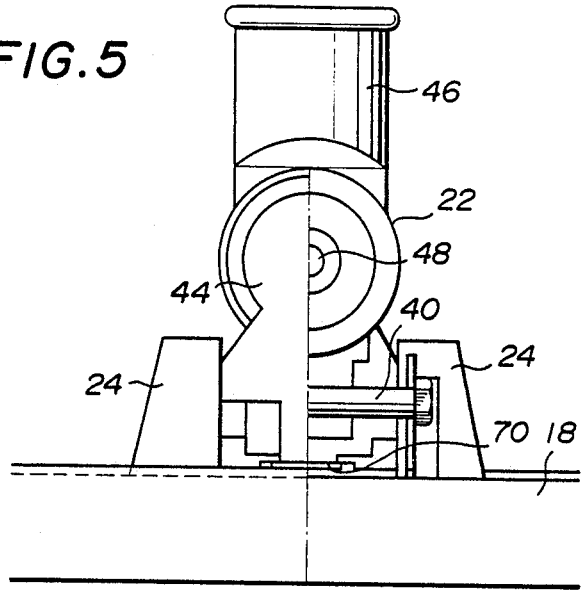
FIGS. 5 and 6 are front and side views each showing a joint portion of the cleaner in which the right side part from the center line of the joint portion is shown in a section.
Figure 6:
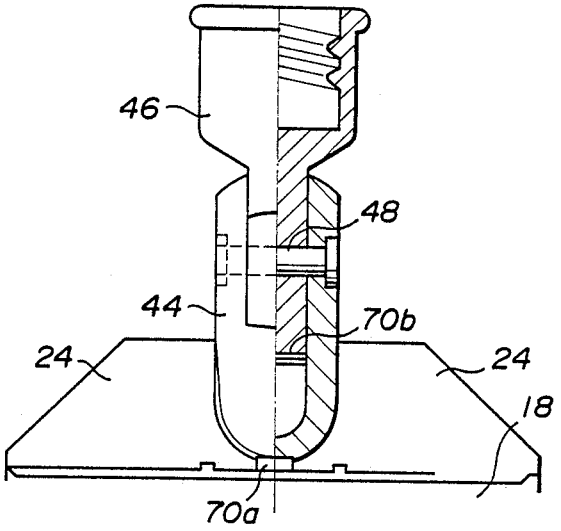
Figure 7:
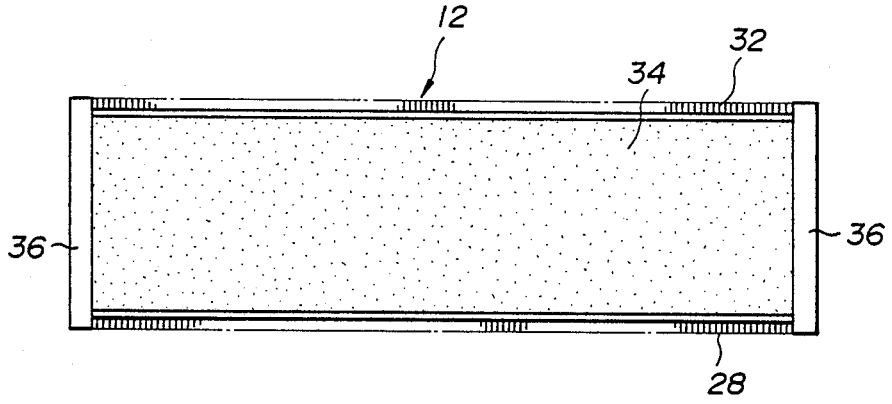
FIG. 7 is a bottom view showing the bottom surface of the cleaner.

In the above-described embodiment, when the opening and closed lever 82 is shifted in the direction of the arrow in FIG. 3(*a*) by a user, the leg portion 84 moves in the notch 80, and the cam member 90 also moves in the direction of the arrow. Thus, the cam surface 92 abuts the extreme end portion 108 of the slider 106, and at the same time the slider 106 shifts outwardly in accordance with the movement of the cam member 90. After the movement of the leg portion 84 in the notch 80 is completed the leg portion is stopped at a locked position A, and the extreme end portion 108 engages running-on surface 94 so that it is held at the locked position. With the outward movement of the slider 108, the stopper 96 extending from the intermediate supporting piece 102 journaled on the slider 108 is opened upwardly, and maintained in the opened state.

The main body 12 in the which the stopper is in opened state is placed on the cloth 14 and at the same time, the main body is tilted to pierce the cloth 14 with the pile 30 thereby placing them in engagement with each other. Thereafter, when steps reverse to those described above are effected, i.e. when the opening and closing lever 106 is shifted to the original position, the cam member 90 also returns to the original position. Since the slider 108 is urged inwardly by means of the coil spring 116, it slips off the cam surface 92 to return the original position. As a result, a closing state of the stopper 96 is realized, and the cloth 14 can be maintained between the main body 12 and an arm portion 100 of the stopper. The above mentioned steps can be performed sufficiently by one hand of a user. The cloth 14 is pierced with the pile 30 mounted along the lower parts 26 of the sides as well as the bottom end portions 28 of the main body 12, and is clamped by the stopper 96. Hence, the cloth 14 is positively held by the main body 12, so that the cloth does not easily slip out from the main body.

Thereafter, a user rubs the bottom surface of the cleaner 10 against any surface to be cleaned while gripping the operation handle 42 to thereby effect dusting.

As described above, since the cloth 14 is retained on the sides of the main body 12 by means of both the pile 30 and the stopper 106, the cloth 14 does not move out of position nor does an end portion of the cloth 14 get turned up by means of the friction generated at a surface to be cleaned, even if the cleaner 10 is moved for cleaning in directions direction, such as lateral directions, diagonal directions and the like. Since the cloth 14 is positively held on the main body 12 by means of both the pile 30 and the stoper 106, it is not necessary to provide a strong maintaining force by enfolding the cloth 14 up to the upper surface of the body (holder) 18.

Even if the surface to be cleaned is rough, since the cushion member 34 is made of an elastic material, shock caused by such roughness on the surface to be cleaned is absorbed by the cushion member 34, so that the cleaner 10 can be moved smoothly.

Furthermore, when the cloth 14 is soiled as a result of dusting, the above-described steps are repeated to strip off the soiled cloth 14 from the main body 12. Then, a fresh cloth is pierced with the pile on the main body 12 as mentioned above, and the fresh cloth is engaged with the stopper 106, whereby such a fresh cloth is attached to the cleaner.

As described above, according to the present invention, a pile composed of short tufts extends from the sides of a main body, fasteners engage the upper surface of the main body are disposed, a cloth having a somewhat larger area than that of the bottom surface of said main body is pierced with said pile, and the cloth is then detachably engaged with the sides of said main body by means of said fasteners, so that the bottom surface of said main body is covered with said cloth. Accordingly, the cloth can be easily exchanged by performing a one hand operation in the cleaner of the present invention so that the use of the cleaner is simple. Moreover, since such a cloth is positively held on the sides of the holder, a portion of the cloth to be enfolded up to the upper surface of the holder is unnecessary, and as a result, a ratio of the surface to be used for cleaning with respect to the area of the cloth is relatively small so that an efficient use of cloth is facilitated.

What is claimed is:

1. A cleaner comprising:

a main body having an upper surface, a bottom surface and opposite side surfaces extending between said upper and said bottom surfaces;

a pile comprising short tufts extending from the opposite side surfaces of said main body;

fasteners disposed on the upper surface of said main body and releasably engageable with the side surfaces of said main body; and a cloth having an area slightly larger than the area of the bottom surface of said main body, said cloth extending over the bottom surface of said main body, said cloth extending over the opposite side surfaces of said main body and pierced by said pile thereat, and said cloth engaged by said fasteners at the opposite side surfaces of said main body so as to be releasably retained thereby against the opposite side surfaces of said main body.

2. A cleaner as claimed in claim 1, wherein each of said fasteners comprises a cover portion having a groove defined therein, an opening and closing lever slidably mounted to said cover portion in said groove, and a stopper operatively connected to said opening and closing lever for opening and closing in response to sliding movement of said lever in the groove of said cover portion, said stopper including an arm portion urged against one of the opposite side surfaces of said main body when said stopper is open and disposed away from said one of the opposite side surfaces said main body when said stopper is closed.

3. A cleaner as claimed in claim 1, wherein said tufts are densely aggregated and extend perpendicularly from the opposite side surfaces of said main body.

* * * * *